US010584484B2

(12) United States Patent
Cohen

(10) Patent No.: US 10,584,484 B2
(45) Date of Patent: Mar. 10, 2020

(54) STACKED STRUCTURAL STEEL WALL TRUSSES

(71) Applicant: VEGA BUILDING SYSTEMS LLC, Englewood, CO (US)

(72) Inventor: David L. Cohen, Englewood, CO (US)

(73) Assignee: Vega Building Systems LLC, Englewood, CO (US)

( * ) Notice: Subject to any disclaimer, the term of this patent is extended or adjusted under 35 U.S.C. 154(b) by 0 days.

(21) Appl. No.: 16/076,688

(22) PCT Filed: Jan. 18, 2017

(86) PCT No.: PCT/US2017/013894
§ 371 (c)(1),
(2) Date: Aug. 8, 2018

(87) PCT Pub. No.: WO2017/146837
PCT Pub. Date: Aug. 31, 2017

(65) Prior Publication Data

US 2019/0048571 A1 Feb. 14, 2019

Related U.S. Application Data

(60) Provisional application No. 62/298,054, filed on Feb. 22, 2016.

(51) Int. Cl.
*E04B 2/58* (2006.01)
*E04B 1/24* (2006.01)
(Continued)

(52) U.S. Cl.
CPC ..... *E04B 2/58* (2013.01); *E04B 1/1909* (2013.01); *E04B 1/24* (2013.01); *E04B 1/2403* (2013.01);
(Continued)

(58) Field of Classification Search
CPC ..... E04B 2/58; E04B 1/1909; E04B 1/2403; E04B 1/24; E04B 2001/2478;
(Continued)

(56) References Cited

U.S. PATENT DOCUMENTS 5,012,622 A * 5/1991 Sato ..... E02D 5/30 52/263
6,625,937 B1 9/2003 Parker
(Continued)

FOREIGN PATENT DOCUMENTS

FR 1 174 724 A 3/1959

*Primary Examiner* — Patrick J Maestri
(74) *Attorney, Agent, or Firm* — Graziano IP Law LLC

(57) ABSTRACT

The present Stacked Wall Truss Construction and its use in multi-story buildings makes use of prefabricated modular wall elements (100) that are interconnected in three dimensions to enable the rapid completion of building construction with improved quality of construction over that found in traditional multi-story building construction. The resultant building is a structural steel frame without the use of stacking columns. Vierendeel trusses (100) with vertical members (101-105) of tube steel are used, thereby the construction process becomes stacking trusses fit up as complete walls, not erecting columns. An inner "Mating Member" (131-135) enables each truss to be near perfectly positioned on top of the installed truss below.

10 Claims, 15 Drawing Sheets

(51) Int. Cl.
*E04B 1/19* (2006.01)
*E04B 1/35* (2006.01)

(52) U.S. Cl.
CPC ... *E04B 2001/199* (2013.01); *E04B 2001/246* (2013.01); *E04B 2001/2406* (2013.01); *E04B 2001/2433* (2013.01); *E04B 2001/2451* (2013.01); *E04B 2001/2463* (2013.01); *E04B 2001/2478* (2013.01); *E04B 2001/2484* (2013.01); *E04B 2001/3583* (2013.01)

(58) Field of Classification Search
CPC ..... E04B 2001/2406; E04B 2001/199; E04B 2001/3583; E04B 2001/2484; E04B 2001/2463; E04B 2001/246; E04B 2001/2451; E04B 2001/2433
See application file for complete search history.

(56) References Cited

U.S. PATENT DOCUMENTS

| | | | | |
|---|---|---|---|---|
| 8,234,827 | B1 | 8/2012 | Schroeder, Sr. | |
| 2011/0146201 | A1* | 6/2011 | Vanker | E04B 1/24 52/792.1 |

* cited by examiner

STACKED STRUCTURAL STEEL WALL TRUSSES

FIELD OF THE INVENTION

This invention relates to the construction of multi-story buildings and, in particular, to the use of Stacked Structural Steel Wall Trusses that are interconnected in three dimensions with other modular construction elements to enable the rapid construction of multi-story buildings with improved quality of construction over that found in traditional multi-story building construction techniques.

BACKGROUND OF THE INVENTION

There are a number of problems associated with the construction of multi-story buildings using the traditional construction techniques of Poured Concrete frame buildings, Pre-Cast Concrete frame buildings, conventional Structural Steel frame buildings, conventional Wood Frame buildings and Masonry construction as described in more detail below. Multi-story buildings constructed with these traditional construction techniques are built in the traditional manner of field craftsmen applying construction materials (dimensional lumber, thin gauge steel members, individual structural steel members) or hardscape materials (cinder block, brick, concrete) to first fabricate the frame of the multi-story dwelling on a foundation at the building site according to a set of architectural plans. While there are few architectural, structural, or dimensional limitations, these construction techniques require a sequential, craft-based, field building format, where item A must be completed before item B can begin, and in turn, item B must then be completed before item C can begin and so on. For example, the ground level walls must be completed before the installation of utilities on the ground level can begin, the second level walls must be completed before substantial work on upper floor walls can begin, and the first floor walls on the building must be framed before finishes can be applied to the first floor walls. While these methods of construction have worked for many years, there are inherent inefficiencies in these methods that result in significant time, cost, and quality penalties.

Traditional construction techniques involve a lengthy process and, therefore, result in construction activity of extended duration. In addition, the finish work is accomplished only after the structural work is completed.

This in situ fabrication results in a lack of quality, is prone to errors, and requires the workers to innovate with respect to the interconnection of utilities, thereby resulting in inconsistency in implementation.

Much of the work done is at the mercy of local weather conditions which can delay schedules and damage materials.

The materials and supplies are mostly hand carried, piece-by-piece, into and within the building during construction, which is an inefficient process.

It is common to have 12- to 30-month construction schedules in the traditional construction of a multi-story building, especially when brick or cinder block construction is used, since these materials inherently limit the daily rise of the walls.

The process is labor intensive, and it is frequently difficult to locate workers of the desired skill level.

There is typically a wide diversity in the quality of building materials that are available and the skills of the workers performing the construction tasks.

Supervision and quality control in traditional multi-story building is non-uniform.

Advantages of traditional construction techniques are that these multi-story buildings can be built to any size or layout that is desired within the limitations of the structural capabilities of the framing material. Multi-story buildings can easily be built with the architectural features, room size, and layout being determined by the architect, builder, and/or owner. Other advantages of traditional multi-story building construction techniques are:

Ability to build a wide diversity of buildings.

Individual customization is easy.

Well known and widely accepted method of construction.

Subcontractors and workers are generally available.

However, this construction process, especially early on, is highly dependent on weather conditions and most often can only occur during daylight hours. An interruption in the flow of construction caused by one of the subcontractors has a ripple effect in that each subcontractor must await the completion of another subcontractor's work before they can begin their work. Furthermore, operating in a field environment is detrimental to maintaining the quality of the construction because it is difficult using portable hand tools to precisely cut and assemble framing material into walls and various finish elements with precise tolerances. It is often difficult in multi-story building construction to find a sufficient number of skilled workmen who can craft a structure of high quality at very reasonable costs. The quality suffers and there is also a significant amount of waste, since the materials must be handled at least two to three times between shipment from the factory or mill to being delivered to the individual job site, and there are many steps of additional material handling on the job site. There is excess labor and significant breakage as a result of this repetitive handling of materials. In addition, typically there aren't people at individual job sites all day to receive materials, so materials and supplies are exposed to the possibility of theft and bad weather. Surplus materials, unless they represent a significant quantity, are discarded since the value of salvaged materials does not offset the cost involved to salvage these materials.

In many areas of the world, population growth is greatly exceeding the growth of available housing. Therefore, one of the primary building construction problems in the world is the ability to very rapidly build large quantities of housing to address the growing deficit. This problem is compounded by limited amounts of skilled labor at a reasonable cost. Traditional construction techniques are not responding to the existing and growing housing shortage, and new means of producing housing in very large quantities effectively and quickly are in great demand.

Thus, traditional construction techniques fail to deliver the quality and speed of construction that is desirable. In many locations, these impediments result in a severe shortage of multi-story buildings and a commensurate lack of available quality buildings.

BRIEF SUMMARY OF THE INVENTION

The present method and apparatus of Constructing Multi-Story Buildings Using Stacked Structural Steel Wall Trusses (also termed "Stacked Wall Truss Construction" herein) has broad application worldwide. The major attributes of the present Stacked Wall Truss Construction are their ability to be used in a huge diversity of building products, with high quality, with a decreased need for skilled labor, at low cost, that can be built in a timely fashion, where an exceedingly high rate of aggregate production to address the present and growing deficits of housing can all be achieved.

The paradigm of the present Stacked Wall Truss Construction fundamentally changes the design process, construction program, and details of constructing multi-story buildings. The building process becomes a rapid assembly program of prefabricated modular building elements, instead of the stick-by-stick accumulation program by craft tradesmen in the field in the traditional construction techniques. The Stacked Wall Truss Construction is a programmatic approach to building design and construction.

The Stacked Wall Truss Construction is a novel design of stacking structural steel Wall Truss Frames, which are structurally either moment frames or braced frames (termed "Wall Truss" herein) where provisions for the installation of coordinated Floor Modules are provided. Unlike many forms of traditional construction, the floors of the multi-story building do not separate the walls at each level of the building. The walls are created with stacking modular elements to form a vertically continuous structure, and the floors are supported by the Floor Shelf at predetermined elevations that facilitate structural connections among the elements and which also provide efficient Utility Interconnect Locations to connect all required plumbing and electrical systems of the building.

The structural steel Wall Trusses can be preferably prefabricated and can, along with other coordinated assemblies, be staged near the multi-story building under construction such that a crane can rapidly transport these modular elements into position on the building under construction. This is a fundamentally different construction process than the traditional construction techniques. In the preferred embodiment, these prefabricated structural steel Wall Trusses typically have a Thin Concrete Wall Panel affixed to the exterior of the structural steel, electrical and plumbing rough utility components installed in the Wall Trusses, and potentially installed windows and interior wall finishes. The coordinated Floor Modules are sized to fit the dimensions established by the installed Wall Trusses and they too include electrical and plumbing infrastructure. Taken all together, these result in a rapid assembly of coordinated modular elements that include the Wall Trusses, Floor Modules, and Kitchen Modules. As a result, construction is transformed from stick-by-stick accumulation in the traditional construction techniques to very rapid assembly of precision engineered, prefabricated, fitted-up or substantially completed components with significant improvements in schedule, cost, quality, and aggregate construction capability.

In the present Stacked Wall Truss Construction, the building is really a structural steel frame without the use of stacking individual or independent columns. Vertical Vierendeel trusses including vertical members of tube steel are used, thereby the construction process involves stacking Wall Trusses, not individual columns. An inner "Mating Member" can be placed hanging out the bottom of each truss (or out of the top of the truss below) such that, when that Wall Truss is crane hoisted up into position, the Mating Member enables the truss to be perfectly positioned on top of the installed Wall Truss below, and the Mating Member also immediately holds the Wall Truss being installed in place as the Mating Member sticks into the column above and column below, typically to an extent of 2 or 3 feet and, as such, the Wall Truss being installed cannot lay over. The Wall Truss is immediately stable upon dropping it into position, and the positioning is near perfect without effort. All Wall Trusses are manufactured to precise dimensional consistency, so assembly of the multi-story building is "Lego™ like," with identical pieces aligning with one another. So Wall Trusses, not individual columns, are stacked. This is different than customary structural steel design, and the floors of the multi-story building are also not interposed between the vertically stacked wall trusses, so this is not like poured-in-place concrete construction or other conventional building methods.

DETAILED DESCRIPTION OF THE INVENTION

Figure 1:
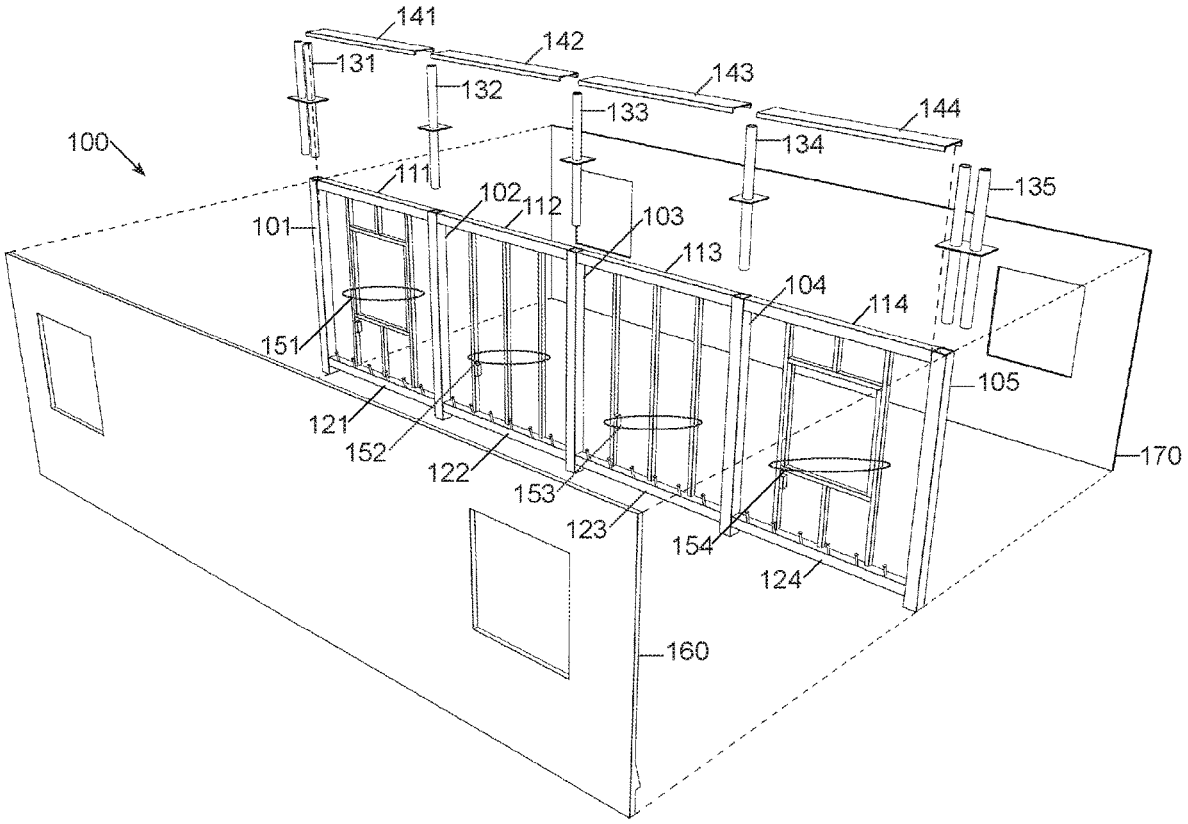
FIG. 1 illustrates a perspective view of a Wall Truss used as a construction element in the Stacked Wall Truss Construction.
Figure 2:
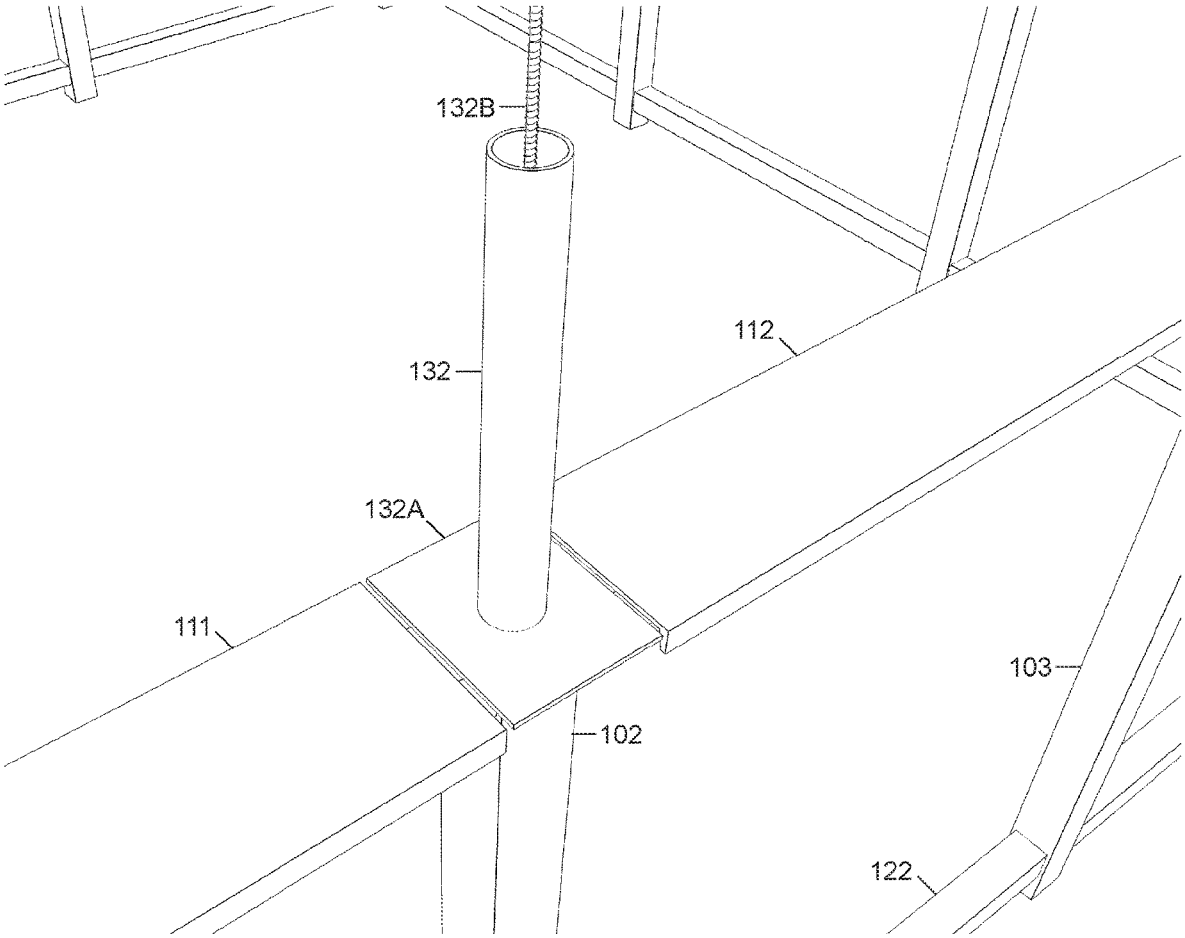
FIG. 2 illustrates a perspective view of a Mating Member installed in the top of a vertical column of a Wall Truss.
Figure 3:
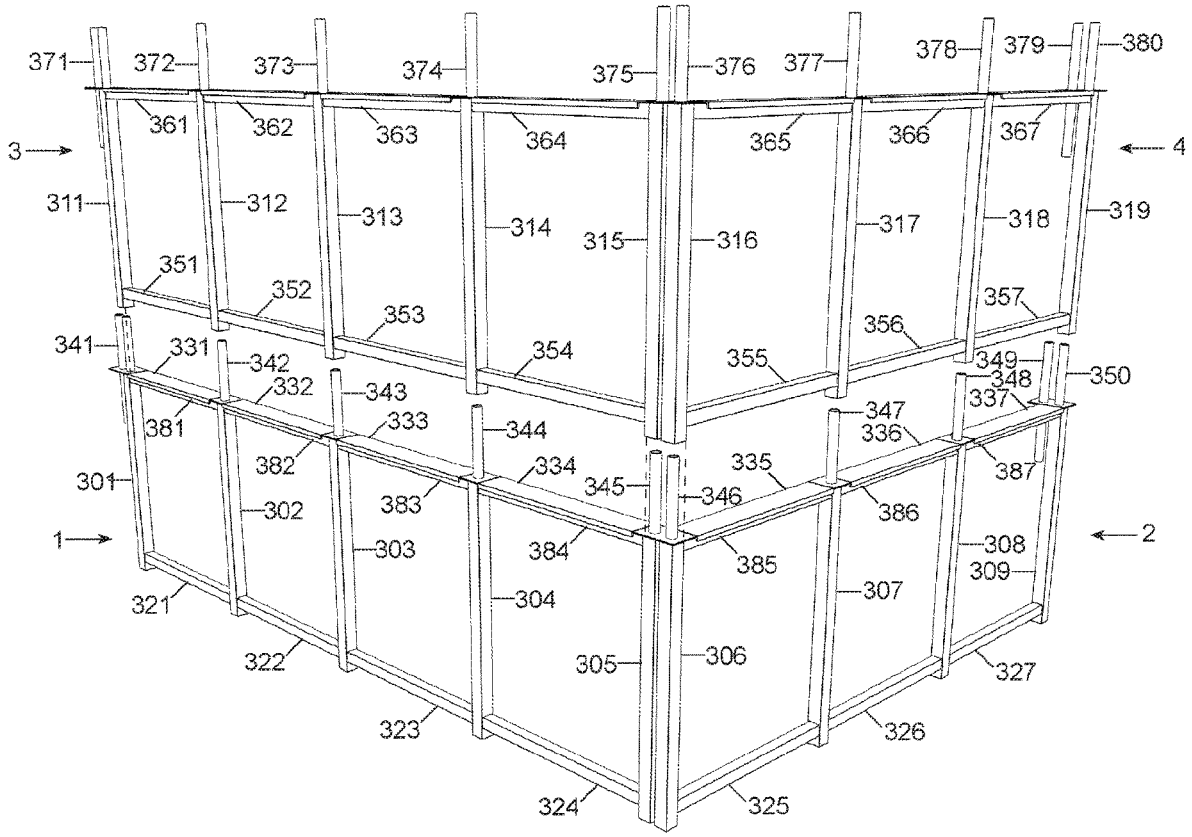
FIG. 3 illustrates a perspective view of two Wall Trusses that are ready to be stacked to become a Stacked Structural Steel Wall Truss, at the corner of a building where the relationship between two Wall Trusses perpendicular to each other can be seen.

As shown in FIGS. 1, 2, and 3, the present Stacked Wall Truss Construction makes use of Wall Trusses 100 that are interconnected in three dimensions. The use of Wall Trusses 100 enables the rapid completion of construction with improved quality over that found in traditional multi-story building construction. FIG. 1 illustrates a perspective view of the Wall Truss 100 which is used as a construction element in the Stacked Wall Truss Construction. The present Wall Truss 100 typically uses Vierendeel trusses or, alternatively, braced trusses (not shown). The Wall Truss 100 can be implemented using a variety of truss technologies to provide the required strength.

Unlike traditional Vierendeel trusses, the horizontal chords or Wall Truss Beams 111-114 and 121-124 do not span the entire length of the Wall Truss 100 and cap the individual Wall Truss Columns 101-105, but instead the Wall Truss Columns 101-105 extend beyond the top and bottom horizontal chords, such that the chords interconnect the Wall Truss Columns 101-105 in a segmented manner. Thus, the horizontal chords do not provide the vertical load carrying capacity, but function to secure and brace the vertical Wall Truss Columns 101-105 to enable them to carry vertical loads and to provide shear capacity for the Wall Truss 100.

The Wall Truss 100 shown in FIG. 1 typically includes a plurality of sets of Framing Members 151-154 which provide the framework for the installation of electrical outlets (not shown), support for plumbing (not shown) and any other utility infrastructure. In addition, they provide the backing to which the Exterior Wall Panel 160, and also Interior Wall Panel 170 are attached. Insulation (not shown) can be installed between or behind the various Framing Members 151-154 before the Interior Wall Panel 170 is attached to the Framing Members 151-154.

Figure 10:
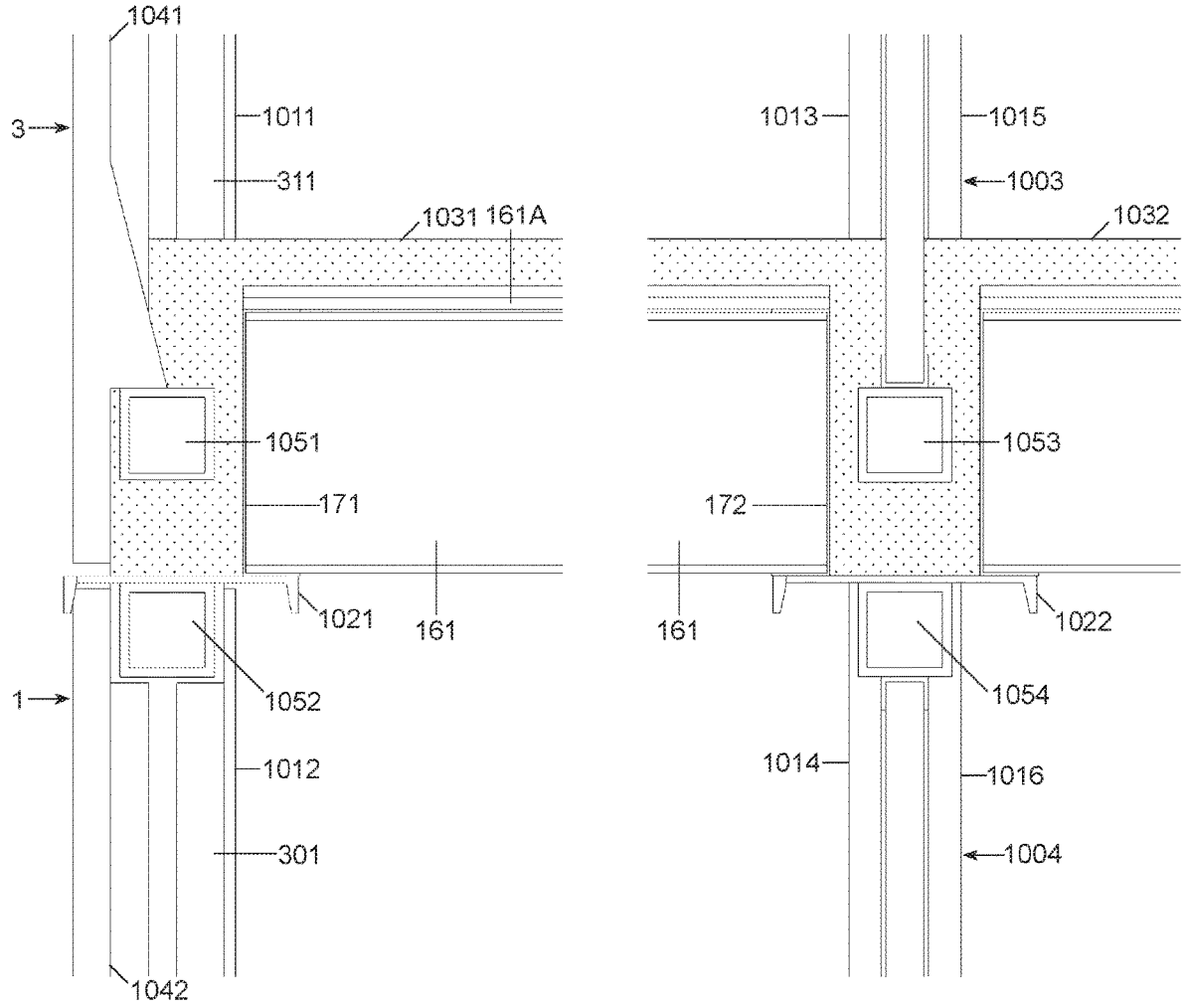
FIG. 10 illustrates a cross-section at the joint between two typical sets of stacked Wall Trusses.
Figure 11A:
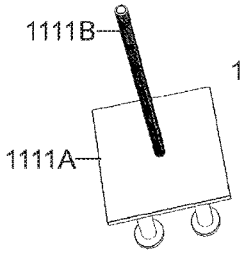
FIGS. 11A-11F illustrate a Foundation Embed Plate-Bolt, which provides for the initial placement of the first floor Wall Trusses on the foundation in a multi-story building.
Figure 11B:
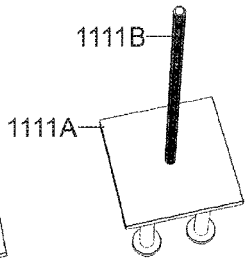
Figure 11C:
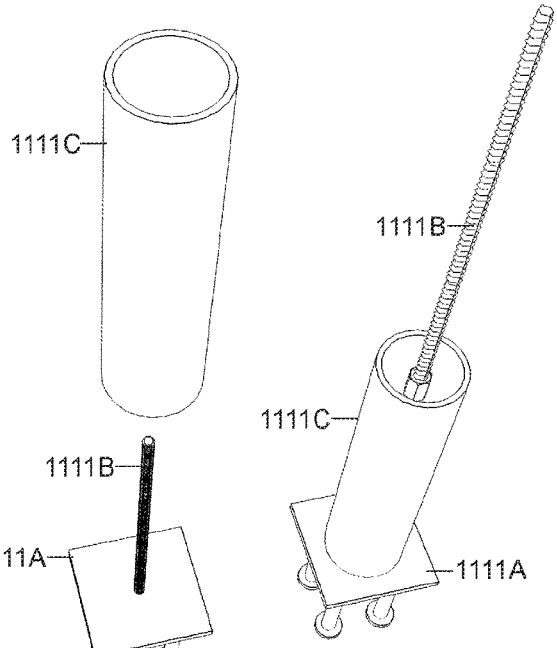
Figure 11D:
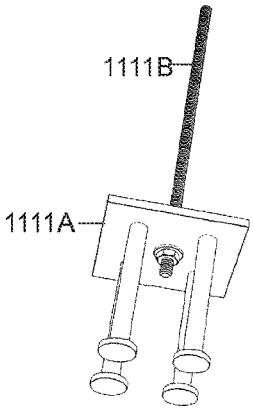
Figure 11E:
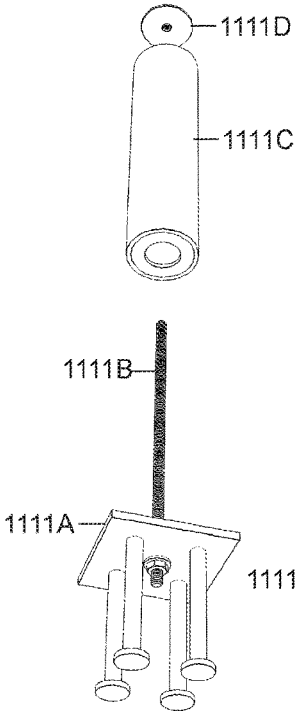
Figure 11F:
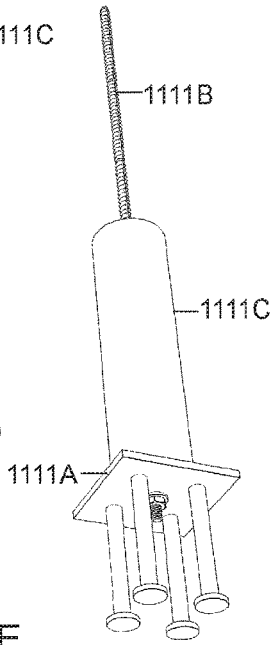

Floor Shelves 141-144 are placed on the top surface of the top horizontal Wall Truss Beams 111-114, and may be tack welded in place to hold them in place until the Wall Truss 100 above is installed, which can optionally be used to sandwich the Floor Shelves 141-144 between the top horizontal beam of a lower Wall Truss 100 and a bottom horizontal beam of a Wall Truss placed on top of this Wall Truss as shown in FIG. 3. The Floor Shelves 141-144, can alternatively be formed of a single planar element having openings formed in a top surface therein corresponding to the Mating Members 131-135, and can be placed on a top horizontal beam of a Wall Truss 100 with the Mating Members 131-135 protruding from the vertical members 101-105 of the Wall Truss 100 being inserted into the openings in the Floor Shelves. The Floor Shelves 141-144 also include a substantially planar surface extending in a horizontal direction perpendicular to the top horizontal beam into the interior of the multi-story building. As described below and illustrated in FIGS. 6 and 10, the Floor Modules 161, 162 are placed directly on the Floor Shelves 141-144 and do not extend horizontally beyond the interior faces of the Wall Trusses 201, 202, as shown in FIG. 10, so this is not a design like poured-in-place concrete where a horizontal floor is physically poured separating the columns above the floor and below it. The Floor Modules 161, 162 can either comprise Floor Plates 161A, 162A placed on top of Floor Joists (ex. 164) which are attached to the top of Floor Shelves 141-144 or alternatively Floor Plates 164A, 164B (or alternative structures) that can be placed directly on top of the Floor Shelves 141-144. The Floor Joists 164 can be fabricated from light gauge steel material and typically would be formed to have holes through the vertical face thereof in a spaced-apart manner to enable the routing of utility components and to reduce the weight of the Floor Joists 164 without compromising the integrity of these elements.

The Stacked Wall Truss Construction as illustrated in FIG. 3 uses prefabricated Wall Trusses 1-4, each of which is formed of a Wall Truss 100, interconnected by Wall Truss Mating Members 341-350. The Wall Truss Mating Members 341-350 can be placed either hanging out of the bottom of an upper Wall Truss 3, 4 or protruding out of the top of a lower Wall Truss 1, 2 as shown in FIG. 3 when Wall Trusses 1, 2 and 3, 4 are being joined together. This enables the installation of a Wall Truss 3, 4 where it is near perfectly positioned on top of the installed Wall Truss 1, 2 below and it also braces and supports the newly installed Wall Truss 3, 4 immediately upon installation, thereby minimizing required crane and crew time. FIG. 2 illustrates a perspective view of a Mating Member 132 installed in the top of a vertical column 102 of a Wall Truss 100. The Mating Member 132 is shown as columnar in shape (it can be any shape, typically square or columnar or polygonal) and fits inside of the vertical column 102, with Floor Shelf 132A limiting the distance that Mating Member 132 enters into vertical column 102 and also maintaining continuity of the Floor Shelves 111, 112. One or more lengths of rebar 132B can be inserted into Mating Member 132 to provide additional strength to the Wall Truss 100 when the Mating Member 132 and vertical column 102 are filled with a filler material, such as concrete, which forms into a solid mass filling the Mating Member 132 and vertical column 102 to create a fixed joint that joins vertically adjacent Wall Trusses 1-4. Alternatively, if the Mating Member 132 is rectangular in shape, it can be welded to the vertical column 102 of Wall Truss 100 to join vertically adjacent Wall Trusses 1-4, or the vertically adjacent Wall Trusses 1-4 can be directly welded or bolted to one another.

Figure 6:
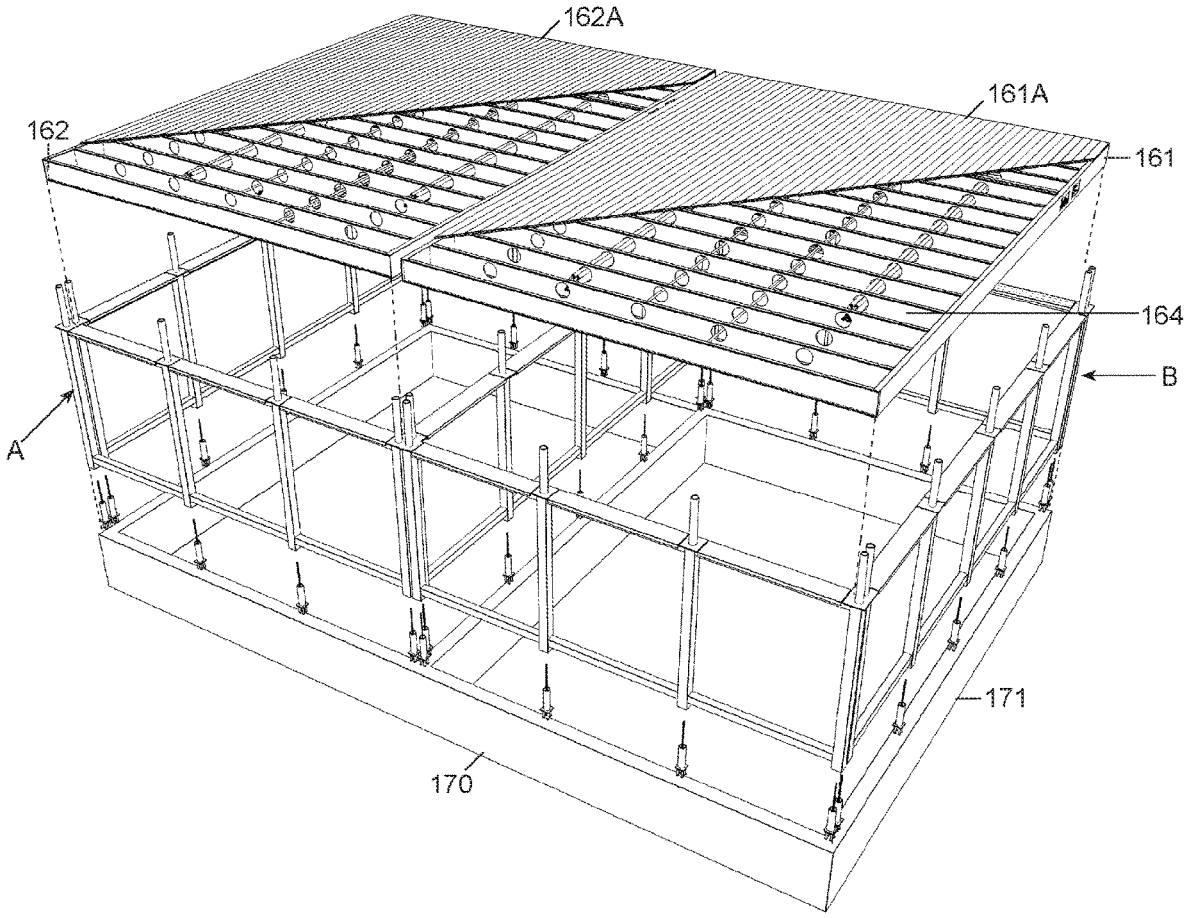
FIG. 6 illustrates a perspective view of a set of Wall Trusses with Floor Modules ready to be lowered on the Floor Shelves in a typical multi-story building using the Stacked Wall Truss Construction design and construction approach for multi-story buildings.
Figure 12:
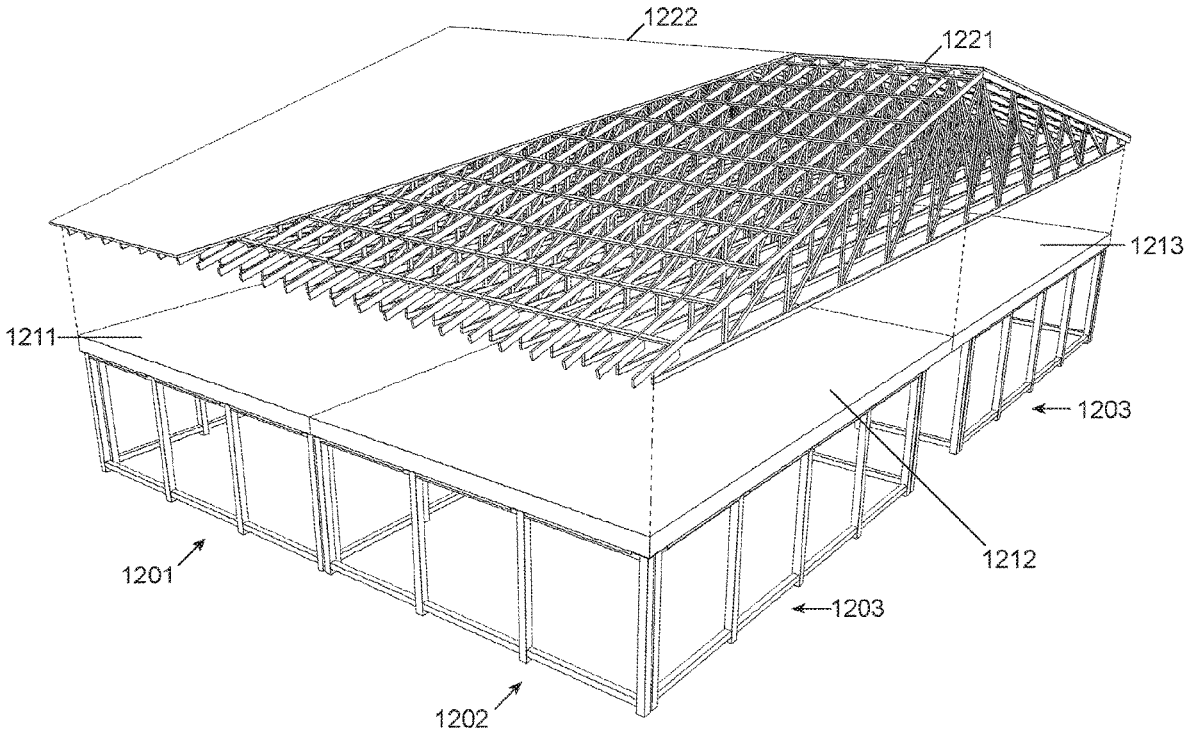
FIG. 12 illustrates a typical roof installation comprising the conventional parallel oriented set of roof trusses, illustrated with the roof sheathing partially removed.

The Stacked Wall Truss Construction enables the construction of multi-story buildings in a highly modular manner because, in addition to the modular Wall Trusses 100, the modular Floor Modules 161, 162, shown in FIGS. 6 and 8, and Kitchen Module 1201, shown in FIG. 12, can also be efficiently constructed off-foundation in a more efficient manner and rapidly incorporated as prefabricated elements into the multi-story building. Additionally, further construction efficiencies result from the fact that wall enclosures and finishes can be affixed to Wall Trusses 100 prior to their installation, and all modules that are a part of the multi-story building can be pre-prepared with plumbing and electrical subsystems because the overall construction has been preplanned for the integration of utilities at specific Utility Interconnection Locations as shown in FIG. 12. The building construction process thereby becoming an engineered, systematic, controlled process of preparing and installing engineered components together where these components connect structurally, with connectable electrical and plumbing systems, and in many cases, with wall finishes preapplied.

Traditional Types of Multi-Story Building Construction

There are several traditional types of multi-story building construction: Poured Concrete frame buildings, Pre-Cast Concrete frame buildings, conventional Structural Steel building frames, conventional wood frame buildings, and Masonry construction.

Poured Concrete Frame Buildings: In most parts of the world, poured-in-place concrete frame buildings are the norm. For each successive floor, columns are poured, a beam is poured on top of the columns to link the columns together, and then a floor is formed and poured on top of the beams and spanning between them to form a monolithic concrete frame. Vertical and shear loads from above are transmitted through the concrete floors downward to columns, beams, and floors in the structure below. This structure takes advantage of the huge compressive capacity of concrete in that, using the third floor as an example with a 20-story building, the vertical compressive loads and the shear loads associated with wind and earthquake of the 17 floors of the building above bear directly on and get transferred through the concrete third floor to the second floor below. Vertical reinforcing steel is placed, typically sticking up and out of columns to extend through beams and floors and into the columns above to provide for vertically continuous tensile strength, which the concrete by itself does not have. Tensile strength is a part of developing required shear strength in the frame of the concrete building.

Pre-Cast Concrete Frame Buildings: Concrete can be pre-cast into 2D or 3D shapes as a means to construct the frame of a structure. These are hoisted into position on the building and affixed together, most commonly via welding steel that spans from an embedded plate in one pre-cast member to a similar embedment in the adjacent pre-cast member. The pre-cast sections have the required structural capacity for vertical loads and shear, as do the connections between the pre-cast sections. Pre-cast frames can include columns, or else the vertical loads would be designed to be carried in wall sections.

Conventional Structural Steel Building Frames: Structural steel has enabled building construction to heights not formerly possible. Steel is a very high strength material, and has considerable strength in both tension and compression (unlike concrete which has just high compressive strength without reinforcing steel). With this high strength material, columns are customarily provided, most often at a significant spacing between them to create column-free open space on floors, and very importantly these columns stack on top of each other and are directly connected together. A continuous vertical load path results where loads transfer from column to column down through the building. This is totally different than the poured concrete frame where the columns are not continuous, as each floor separated them. Horizontal beams are provided that affix to columns, and these beams brace the columns, create shear capacity in the overall frame, and support floors by transferring the floor weight over to the columns. As buildings get tall, the columns get big, and the beam sizes need to grow to stabilize the vertical columns and to create shear capacity in the overall frame of the tall building. This works well. We are all familiar with the look of a structural steel framed building and the "heavy" scale of the column and beam framework, and the resultant ability to build high, wide open floor plans and also to create broad, open window sections in exterior walls.

Conventional Wood Frame: This building architecture became common when trees were sawn into dimensional lumber of consistent sizes. This enabled wood framing to proliferate in areas where forests are common.

Masonry Construction: Perhaps one of the oldest construction techniques is Masonry construction. Making bricks and then laying the bricks into walls is not only a historic practice but remains a common practice in modern construction. Masonry walls are used to create load bearing walls, where loads from above are supported by the masonry, and masonry walls are also utilized in non-load bearing configurations such as the in-fill walls of a poured concrete frame building. Masonry can develop relatively high compressive strength including both the bricks and mortar, but (unreinforced) masonry is a low strength material in tension. Accordingly, there are limitations in the application of Masonry construction; further, masonry is laid by hand so quality and appearance are inherently prone to variability.

Another distinction in types of multi-story construction is the use of trusses. This building component can be found in all four traditional types of multi-story building construction, and it is further described in the next section.

Basic Truss Technology

The Wall Truss 100 can be fabricated using either braced frames or moment frames from a structural standpoint. Shear loads in a braced frame are carried by bracing members; shear loads in moment frames are carried by the moment capacity of the connections between the members of the frame. In the present Stacked Wall Truss Construction, the Wall Trusses 100 are demonstrated using a Vierendeel truss configuration. Basic truss technology and Vierendeel truss characteristics are described below.

In engineering, a classic truss is a structure that consists of two-force members only, where the members are organized so that the assemblage as a whole behaves as a single object. A "two-force member" is a structural component where force is applied to only two points. Although this rigorous definition allows the members that form a truss to have any shape and be interconnected in any stable configuration, trusses typically comprise five or more triangular units constructed with straight members whose ends are connected at joints referred to as nodes. In this typical context, external forces and reactions to those forces are considered to act only at the nodes and result in forces in the members which are either tensile or compressive. For straight members, moments (torques) are explicitly excluded because, and only because, all the joints in a truss are treated as revolutes, as is necessary for the links to be two-force members.

A traditional planar truss is one where all the members and nodes lie within a two-dimensional plane, while a space truss has members and nodes extending into three dimensions. The top beams in a truss are called top chords and are typically in compression, the bottom beams are called bottom chords and are typically in tension, the interior beams are called webs, and the areas inside the webs are called panels. A truss consists of typically straight members connected at joints, traditionally termed panel points. Trusses are typically geometric figures that do not change shape when the lengths of the sides are fixed and are commonly composed of triangles because of the structural stability of that shape and design. A triangle is the simplest comparison, but both the angles and the lengths of a four-sided figure must be fixed for it to retain its shape.

A truss can be thought of as a beam where the web consists of a series of separate members instead of a continuous plate. In the truss, the lower horizontal member (the bottom chord) and the upper horizontal member (the top chord) carry tension and compression, fulfilling the same function as the flanges of an I-beam. Which chord carries tension and which carries compression depends on the overall direction of bending.

Figure 15:
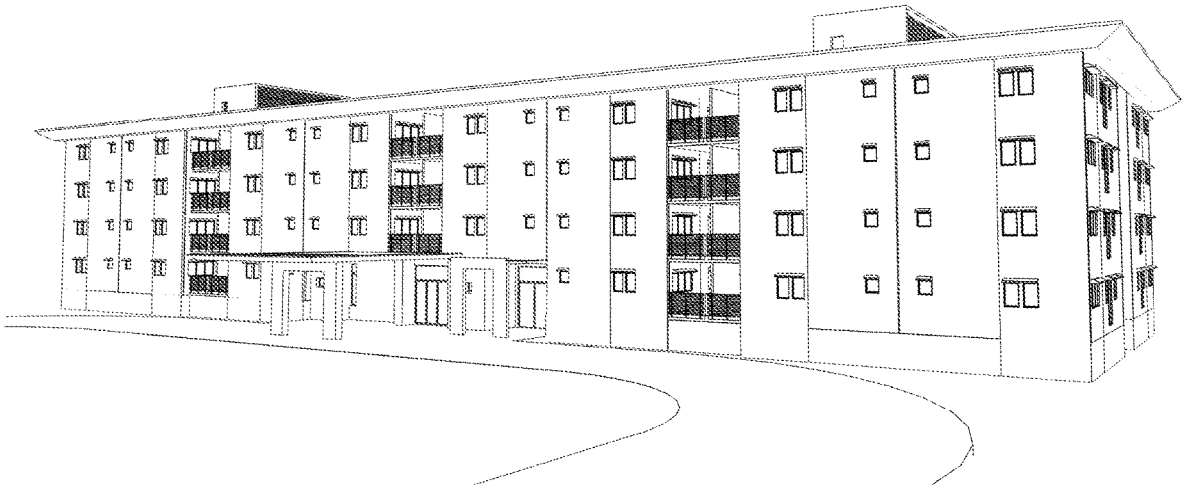
FIG. 15 illustrates a typical completed multi-story building using the Stacked Wall Truss Construction.

A variation of the planar truss is the Vierendeel truss which is a structure where the members are not triangulated but form rectangular openings and is a frame with fixed joints that are capable of transferring and resisting bending moments. Vierendeel trusses are rigidly-jointed trusses having only vertical members interconnected by the top and bottom chords which connect to a side of the vertical members which face adjacent vertical members and at a location a predetermined distance below the top of the vertical members. The chords are normally parallel or near parallel. Elements in Vierendeel trusses are subjected to bending, axial force, and shear, unlike conventional trusses with diagonal web members where the members are primarily designed for axial loads. As such, it does not fit the strict definition of a truss (since it contains non-two-force members); regular trusses comprise members that are commonly assumed to have pinned joints, with the implication that no moments exist at the jointed ends. The utility of this type of structure in buildings is that a large amount of the exterior envelope remains unobstructed and can be used for fenestration and door openings as shown in FIGS. 1 and 15. This is preferable to a braced-frame system, which would leave some areas obstructed by the diagonal braces.

Concrete Technology

Concrete is a composite material composed of coarse aggregate bonded together with a fluid cement which hardens over time. Most concretes used are lime-based concretes such as Portland cement concrete or concretes made with other hydraulic cements, such as fondants. In Portland cement concrete (and other hydraulic cement concretes), when the aggregate is mixed together with the dry cement and water, they form a fluid mass that is easily molded into shape. The cement reacts chemically with the water and other ingredients to form a hard matrix which binds all the materials together into a durable stone-like material. Often, additives (such as pozzolans or super plasticizers) are included in the mixture to improve the physical properties of the wet mix or the finished material. Most concrete is poured with reinforcing materials (such as rebar) embedded to provide tensile strength, yielding reinforced concrete. Thus, concrete can be poured into a form or column and will conform to the shape of the form, hardening in place to lock the elements in a durable stone-like material.

Stacked Wall Truss Construction

FIGS. 1 and 3 illustrate, respectively, a perspective view of the Wall Truss 100 and the joining of vertically stacked Wall Trusses 1-4—one above the other, where the lower stacked Wall Truss 1 is adjacent to a perpendicular stacked Wall Truss 2 and the upper stacked Wall Truss 3 is adjacent to a perpendicular stacked Wall Truss 4, with the exterior wall coverings removed in this Figure such that steel members of the Wall Trusses 1-4 can be seen. In the Stacked Wall Truss Construction, the building is really a set of stacked structural steel trusses without the use of individual vertically stacked columns. The design of the Stacked Wall Truss Construction multi-story building creates walls of vertically stacked Wall Trusses 1-4, not individual steel or concrete column framing members. The resultant multi-story building is a plurality of wall trusses interconnected in a three-dimensional matrix to form both a plurality of multi-story external walls to enclose a volume of space and a plurality of internal structural partitions which are connected together and to the external walls in at least two planar layers to provide lateral support to the external walls to which they are interconnected.

In this structure, each Wall Truss 1-4, as shown in FIG. 3, consists of a plurality of linearly aligned vertical columns 301-309, 311-319 along a horizontal length, at least two of the vertical columns in each Wall Truss 1-4 typically comprising hollow columns, and adjacent vertical columns are interconnected at the top and bottom by horizontal beams 321-327, 381-387, 351-357, 361-367. As shown in FIG. 3, Wall Trusses 1-4 are interconnected by the use of Mating Members 341-350, each insertable into top ends of the hollow columns of a first set of Wall Trusses 1, 2 where the Mating Members 341-350 protrude above the top of the hollow column in which it is inserted and the bottom end of the hollow column of a second set of Wall Trusses 3, 4 that are vertically positioned on top of the first set of Wall Trusses 1, 2, such that when the Wall Trusses 3, 4 are crane hoisted up into position, the Mating Members 341-350 enable the Wall Trusses 3, 4 to be near perfectly positioned on top of the installed Wall Trusses 1, 2 located below, and the Mating Members 341-350 also hold the Wall Trusses 3, 4 being installed in place immediately as the Mating Members 341-350 sticks into the Wall Truss Columns above 311-319 and below 301-309, to an extent the Wall Trusses 3, 4 being installed will not lay over. It is stable immediately upon dropping it into position, and the positioning is perfect without effort. In addition, the Floor Shelves 331-337 are inserted between Wall Trusses 1-4. All Wall Trusses 1-4 are manufactured to precise dimensional consistency, so assembly is reliable and simple with identical pieces aligning with one another. So Wall Trusses 1-4 stack, not individual columns, which is different than customary structural steel design and construction. In addition, the wall thickness of the vertical columns can vary as their location in the multi-story building varies, with upper floors of the building requiring lighter wall materials since the load carried there is reduced from that of the lower floors. As described in more detail below, the end Wall Truss Columns 305, 306, 315, and 316 of the Wall Trusses 1, 2 and 3, 4 shown can be affixed together by means of welding, pinning, bolting, strapping, concrete infill and/or other means.

Figure 4:
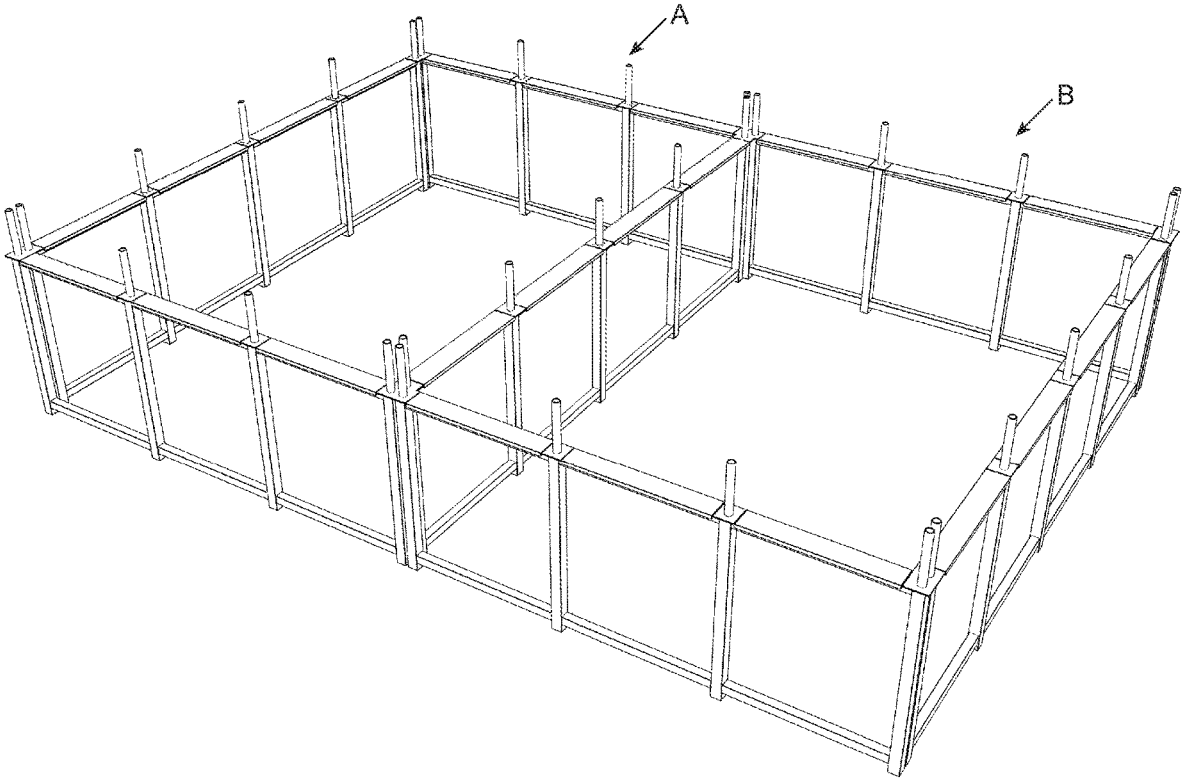
FIG. 4 illustrates a perspective view of the installed arrangement of Wall Trusses showing their relationship to other Wall Trusses and the Floor Shelf installed near the top of the Wall Trusses.
Figure 5:
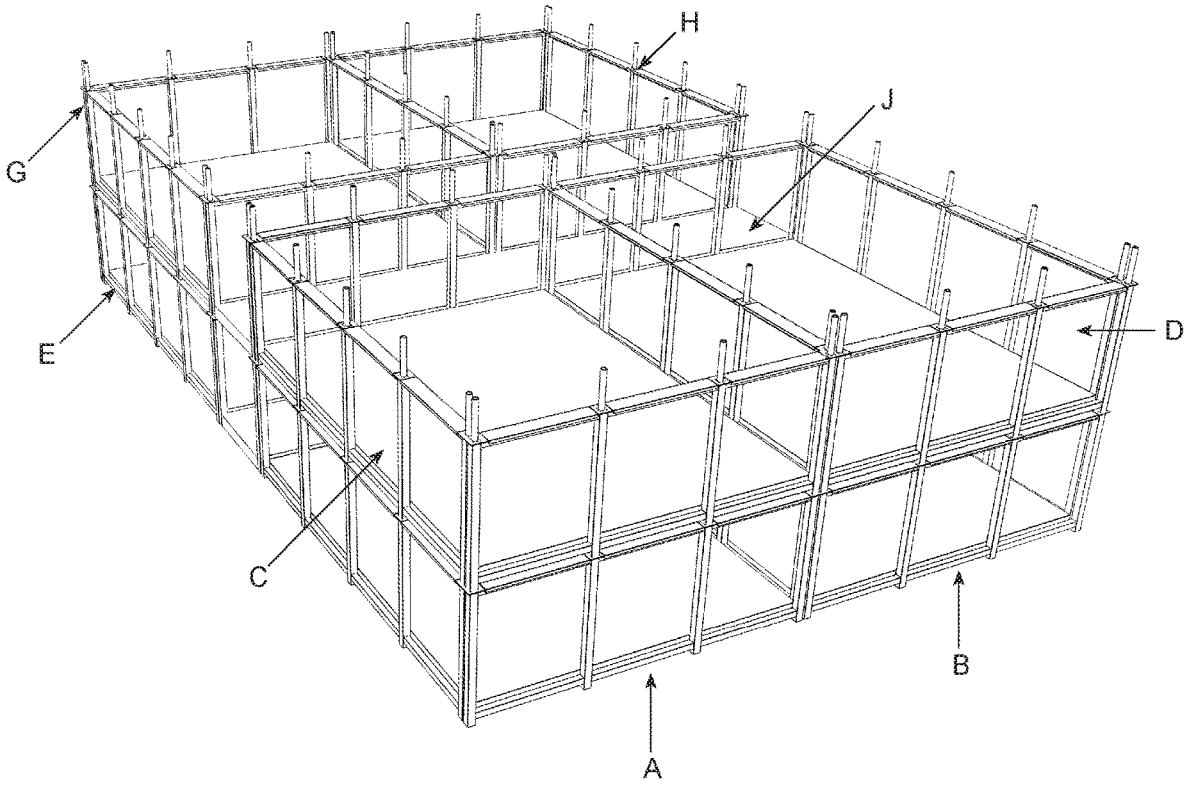
FIG. 5 illustrates a perspective view of a set of Wall Trusses with Floor Modules in a typical multi-story building using the Stacked Wall Truss Construction design and construction approach for multi-story buildings.

A sequential set of images to illustrate the construction method using the Wall Trusses of the present invention comprises FIG. 4 which illustrates a perspective view of the installed arrangement of Wall Trusses for two apartments, the Floor Shelf installed near the top of the upper Wall Truss; FIG. 5 which illustrates a perspective view of a set of Wall Trusses with Floor Modules in a typical multi-story building using the Stacked Wall Truss Construction design and construction approach for multi-story buildings of the present invention; and FIG. 6 which illustrates a perspective view of a set of Wall Trusses ready to receive a Floor Module which will be placed on the Floor Shelves in a typical multi-story building using the Stacked Wall Truss Construction design and construction approach for multi-story buildings of the present invention.

As shown in FIG. 4, the Wall Trusses can be interconnected to form two enclosed spaces A, B; and this form can be expanded in three dimensions to form a multi-story framework as shown in FIG. 5. The basic Wall Truss spaces A, B can be joined with a mating set of enclosed spaces C, D added to the top thereof to form a two-story framework. The Wall Truss spaces A, B include Floor Shelves as described above and shown in FIG. 5, and the Floor Modules are placed thereon to provide a floor for the Wall Truss spaces C, D. A corresponding set of two-story Wall Truss spaces E-H can be located juxtaposed to Wall Truss spaced A-D, separated therefrom by common area space J. This structure is illustrated in a more finished form in FIGS. 14 and 15, which are described below.

Floor Modules

Figure 7:
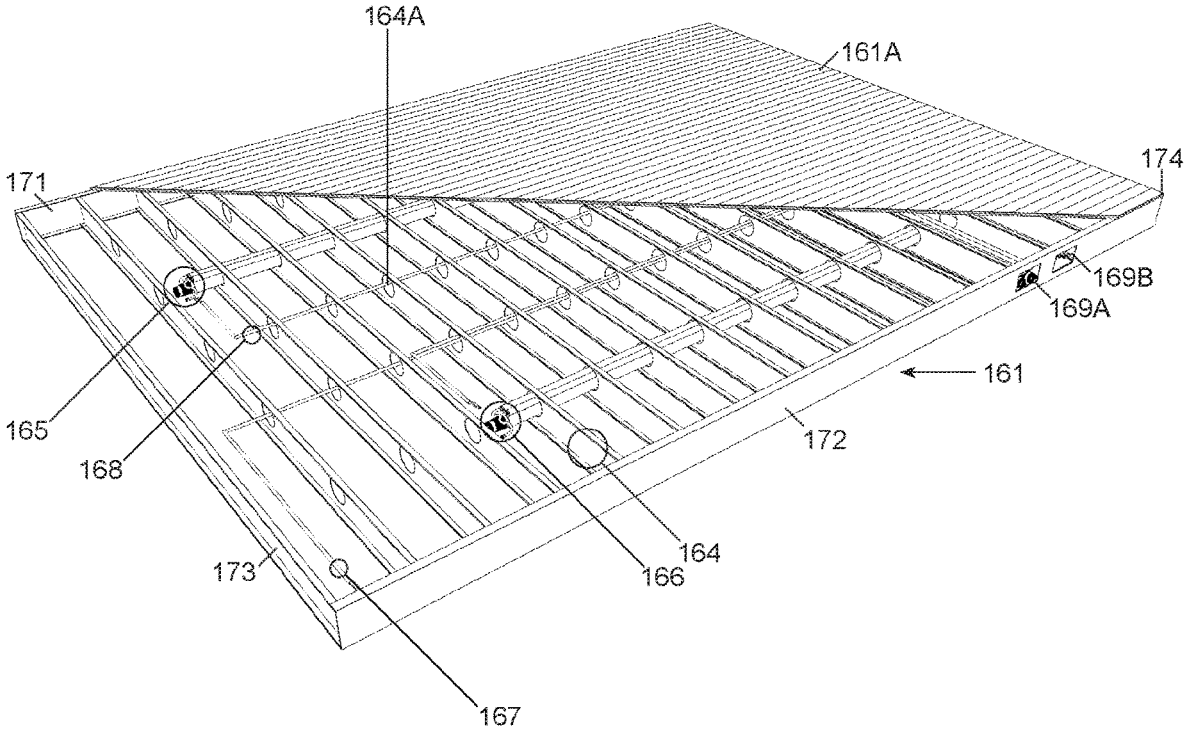
FIGS. 7 and 8 illustrate additional detail of a Floor Module, where the Floor Plate is cut away in part to expose the Floor Joists and utilities.

FIGS. 6 and 7 illustrate details of Floor Modules 161, 162. Each Floor Module, such as 161, consists of a plurality of parallel oriented, spaced apart Floor Joists, such as Floor Joist 164, which has formed therein a plurality of cutouts 164A (FIG. 7) through which utilities can be routed. Floor Modules 161, 162 are the support for Floor Plates 161A, 162A, which provide a substrate for the flooring, such as a Topping Slab 1031 (illustrated in FIG. 10). FIG. 6 also illustrates the provision of foundation walls 170, 171, which have embedded therein Foundation Embed Plate Bolts on top of which are affixed Mating Members, as described below (collectively termed "Mating Anchors" herein). The Floor Modules 161, 162, with their respective Floor Plates 161A, 162A, are installed on the Floor Shelves of enclosed spaces A, B.

Figures 8A, 8B:
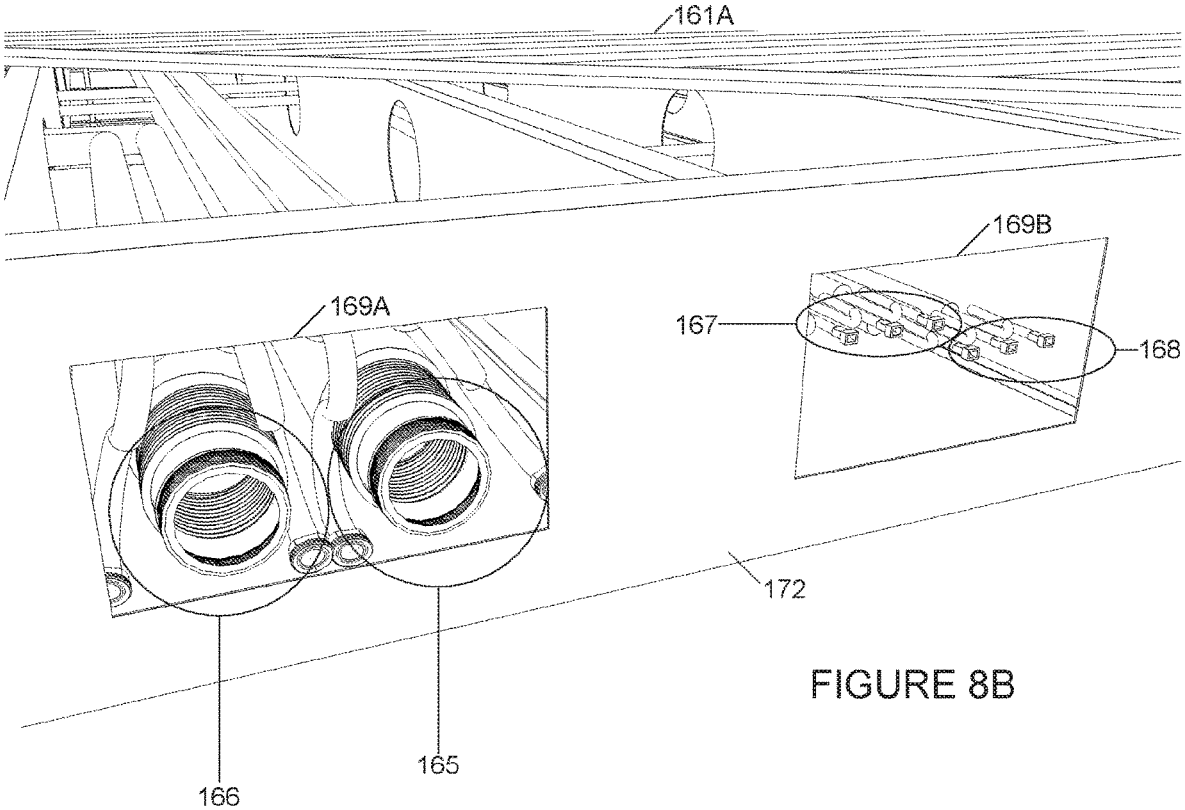

FIG. 7 illustrates additional detail of a Floor Module 161, where the Floor Plate 161A is cut away in part to expose the Floor Joists 164. The Floor Joists 164 are capped at their ends with Capping Track 171, 172 which are interconnected at their ends with Floor Joists 173, 174 which do not have any openings formed therein. Thus, elements 171-174 create a solid perimeter surface frame for Floor Module 161 to enable a Topping Slab 1031 (illustrated in FIG. 10) to be poured on top of Floor Plate 161A and to extend into the spaces between Floor Module 161 and the surrounding Wall Trusses as described below. Various utilities are mounted in Floor Module 161 by routing between adjacent Floor Joists 164 and through the openings 164A formed in Floor Joists 164. Electrical services 167, 168 are shown, as are water and waste plumbing 165, 166. All of these utilities are routed to a side 172 of Floor Module 161, where they are presented at openings 169A, 169B, with each opening providing access to a set of utilities. FIGS. 8A and 8B illustrate a close-up view of openings 169A, 169B and the respective plumbing 165, 166 and electrical 167, 168 utility interconnects.

Figure 9:
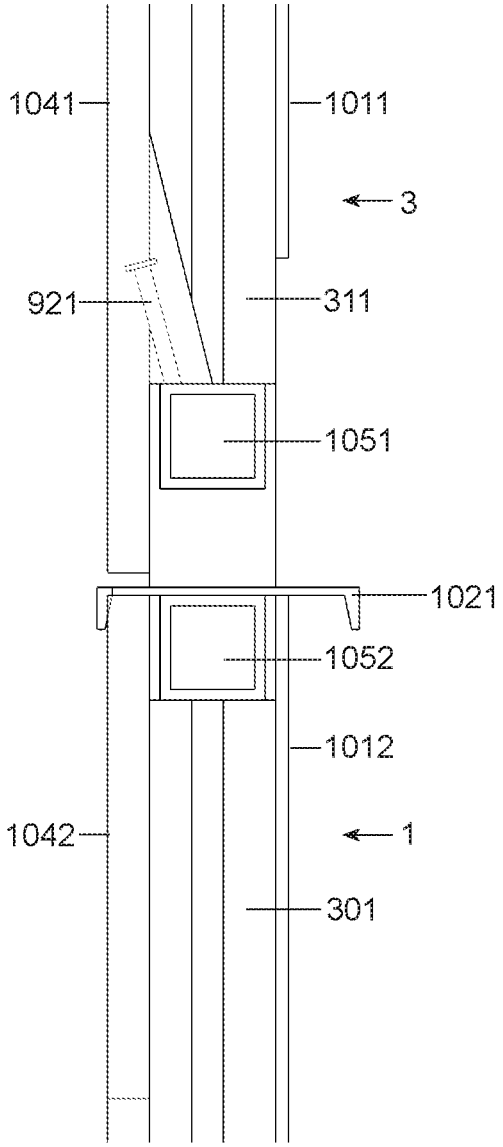
FIG. 9 is a cross-section view of an exterior wall of a multi-story building.

FIG. 9 is a cross-section view of an exterior wall of a multi-story building, where Wall Truss 3 is mounted on top of Wall Truss 1. The Wall Trusses 1, 3 comprise vertical columns 303, 311 interconnected by a Mating Member having a Floor Shelf 1021 segment. A cross-section of Horizontal Members 1051, 1052 are shown for illustrative purposes. Exterior Wall Slabs 1042, 1041 are affixed to Wall Trusses 1, 3, respectively. The Exterior Wall Slab 1042 is secured in place on the top side thereof, by the overhang of Floor Shelf 1021 turning in a downward direction. The bottom side of each Exterior Wall Slab 1041 is secured by the projection/wall pocket 921. The space between respective Exterior Wall Slabs 1041, 1042 can be filled by the application of a filler material, which provides protection from the elements. On the interior side of the Wall Trusses 1, 3, Wall Coverings 1011, 1012 are secured to the vertical columns 311, 301 in a conventional manner.

Floor Cross-Section

FIG. 10 illustrates a cross-section at the joint between two typical sets of stacked Wall Trusses 1-3 and 1003-1004. Additionally, FIG. 10 shows the Topping Slab 1031 poured on top of the Floor Module 161 and also filling the gaps (fluid receiving pockets) between the edges of the Floor Shelf 1021, 1022 and the Wall Truss 1, 1003. FIG. 10 also shows a thin concrete Exterior Wall Panels 1041, 1042 utilized in the preferred embodiment, where this thin concrete Exterior Wall Panels 1041, 1042 are affixed to the Wall Trusses 3, 1 prior to the Wall Trusses 3, 1 being installed on the building, where the Exterior Wall Panels 1041, 1042 are on the outside of Wall Trusses 3, 1 in an exterior condition, and thin concrete Wall Panels 1013-1016 used on Wall Trusses 3, 1, 1003, 1004 where it functions as a fireproof and soundproof interior separation as needed in a multi-story building.

FIG. 10 also illustrates only a portion of the Wall Trusses 1, 3, 1003, 1004 and coordinated components in the interest of clarity, due to the limited space available in the Figure. The Wall Trusses 1, 3 each contain a Wall Truss Column such as 301, 311, respectively, to which is affixed a concrete Wall Panel 1041-1042, in the case of Wall Truss Columns 311, 301, as the exterior finish of the building. Wall Truss Columns 311, 301 are interconnected to their respective adjacent Wall Truss Column (not shown) via two horizontal Wall Truss Beams, two of which 1051-1052, respectively, are illustrated in FIG. 10 (as are horizontal Wall Truss Beams 1053, 1054 for Wall Trusses 1003, 1004). In order for this structure to support floors, Floor Shelves 1021, 1022 are attached to the horizontal Wall Truss Beams 1052 and 1054, by welding, bolting, or some other structural connection, respectively, to receive Floor Module 161 which is the floor load bearing element between facing Floor Shelves 1021, 1022. The Floor Shelf 1021 runs the length of Wall Truss 1. The Floor Module 161 as shown in FIGS. 6 and 7 is placed on top of the Floor Shelves 1021, 1022 and span the opening between the walls formed by the Wall Trusses 1, 3, 1003, 1004. The Floor Module 161 consists of a plurality of substantially parallel oriented Floor Joists 164 on top of which are placed a Deck 161A which provides a solid surface on top of which the Topping Slab 1031 can be poured. In this case, a thin Topping Slab 1031 of concrete is poured on top of the Deck 161A, and this Topping Slab 1031 also fills the space between the Floor Module 161 and the Wall Trusses 3, 1003. The Floor Module 161 shown in the preferred embodiment of FIGS. 6, 7, and 10 is framed with light gauge steel Floor Joists 164 spanning one direction and a Capping Track 171, 172 which caps and encloses the ends of the Floor Joists 164 in the Floor Module 161 on the two sides of the Floor Module 161 which have the ends of the light gauge joists. The Topping Slab 1031 also fills the void between Wall Trusses 3 and 1003 and other similar locations, since Capping Tracks 171, 172 and End Joists 173, 174 in combination with Floor Shelves 1021, 1022 form a pocket into which the concrete poured for Topping Slab 1031 can flow to create an integral structure (floor slab anchor) that locks the Floor Module 161 to the Wall Trusses 3, 1003. This concrete Topping Slab 1031 can be finished to become the final interior finish or can be the subfloor for carpeting, or tile, or wood flooring, or the like. Deck 161A is supported by Floor Module 161, and concrete floor finish Topping Slab 1031 is applied thereto. When the Wall Trusses are affixed to one another both horizontally and vertically to stabilize them in three dimensions and the Topping Slab 1031 is poured to further affix the Wall Trusses 3, 1003 together and to also structurally integrate the Floor Module 161 with all of the Wall Trusses 3, 1003, a structurally integrated assembly is created where all coordinated assemblies are structurally interconnected and act as a structural whole.

Figure 13:
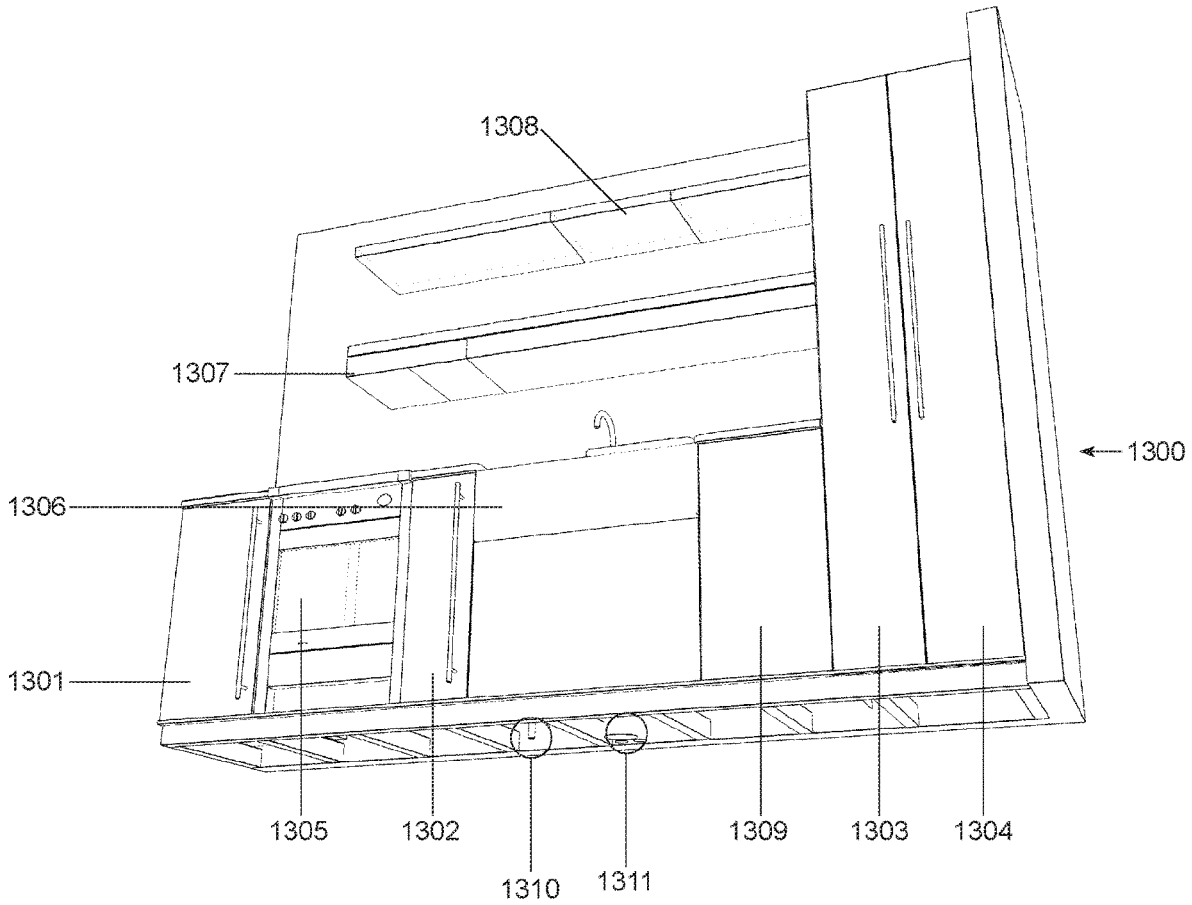
FIG. 13 illustrates a prefabricated Kitchen Module for installation on top of a Floor Module in a dwelling unit.

FIG. 13 illustrates a typical Kitchen Module 1300 for a kitchen, which includes a stove/range 1305, a sink 1306, cabinets 1301-1304, 1309, light fixtures 1307, 1308 and the like. The utilities 1310, 1311 serving these appliances are run to interconnect points in the appliance module 1300, which utilities mate with the utilities that are pre-installed in the Floor Module 161 as disclosed above. The interconnection of the utilities 1310, 1311 can be done after the Topping Slab 1031 is installed which simplifies the construction of the finish in the dwelling unit.

Roof

FIG. 12 illustrates a typical roof installation comprising the conventional parallel oriented set of roof joists 1221, illustrated with the roof sheathing 1222 partially removed. The roof can be attached to the top floor of the multi-story building using conventional techniques to connect to Wall Trusses 1201-1204 and their Floor Modules 1211-1213 and can be of any style and finish.

Figure 14:
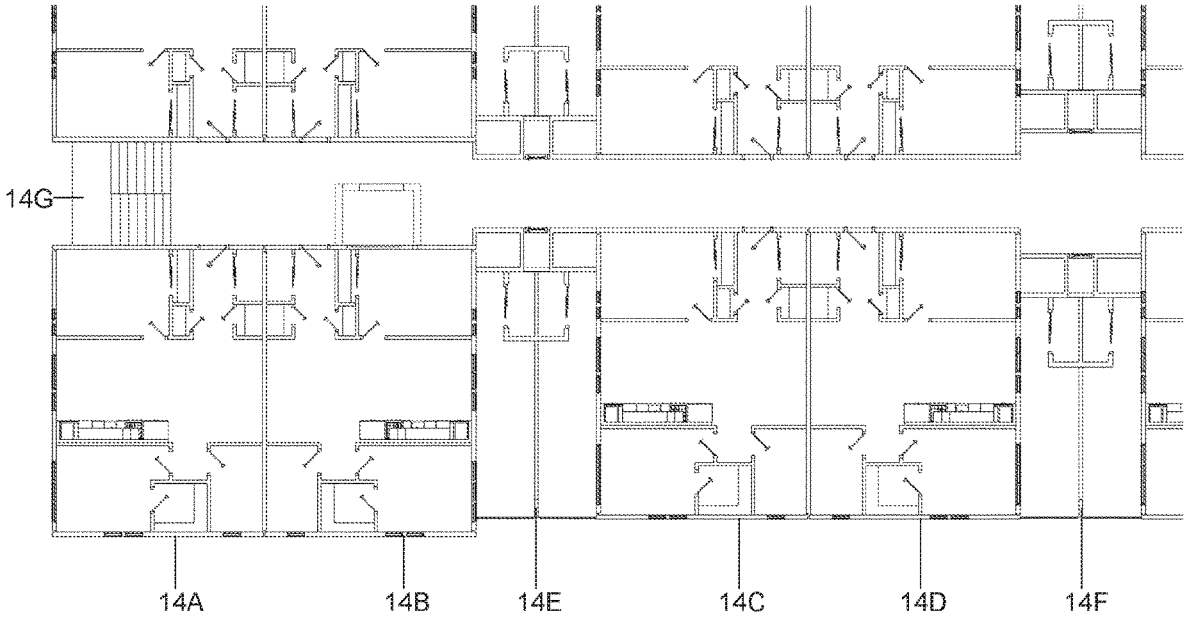
FIG. 14 illustrates a floor plan of a segment of a typical residential multi-story building.

In the multi-story residential building application described herein, FIG. 14 illustrates two apartment units 401, 402 and their respective walls 403-407. Walls 403 and 405 each consist of five Wall Truss Columns 451-455 and 456-460, respectively, which Wall Truss Columns are interconnected by pairs of Wall Truss Beams 411-414 and 415-418, respectively. In a similar manner, walls 404, 406, 407 each consist of five Wall Truss Columns 461-465, 466-470, and 471-475, respectively, which Wall Truss Columns are interconnected by pairs of Wall Truss Beams 421-424, 431-434, 441-444, respectively. This plan view illustrates the location of the Wall Truss Beams, which are in practice two chords per span, one at the top of the Wall Truss Columns and one at the bottom of the Wall Truss Columns as diagrammed in FIG. 5.

Foundation

FIGS. 11A-11F illustrate a mechanism that can be used to transition from the customary poured concrete foundation 170 and 171 (in FIG. 6) of a multi-story building to a precision dimensioned framing system that must lean on and be affixed to the field-poured concrete. It is almost impossible to precisely control the resulting finished dimensions of field poured concrete or embedments cast into the concrete. The precise dimension Wall Trusses require a corresponding precision at their affixment point to the foundation at each Wall Truss Column. Weld plates are commonly embedded in field-poured concrete as an attachment point for later stages of construction. FIG. 11 shows an Anchor Member that includes a novel weld plate 1111A where it has been center drilled and a threaded steel rod 1111B or bolt is affixed to the weld plate 1111A with a threaded portion of the rod 1111B extending upward. In this configuration, the weld plate 1111A with threaded rod 1111B attached can be embedded in the concrete during pouring, and the embedment studs secure the weld plate 1111A with threaded bolt 1111B securely. To easily correct any misalignment, a Mating Member 1111C could have a flat plate 1111Q with a hole in it welded to one end.

This hole might be 1⅜ inches, and the threaded rod might be ⅜ inches. If the rod were in perfect position, it would be in the center of this hole creating a ½ inch uniform gap all around it. However, the threaded rod could be out of position by up to ½ inch, and it would be simple and easy to slide the Mating Member 1111C into proper position, and then affix it with a large washer and nut 1111D, and likely subsequent welding, to the weld plate 1111A. A perfect starting point for a precision Wall Truss results.

The distinction between the present Stacked Wall Truss Construction and the prior art grows with the design and construction of the floors and horizontal components of the building frame. The prior art structural steel frame had substantial horizontal beams framing into the individual steel columns, while the present Stacked Wall Truss Construction does not. By placing vertical Wall Trusses in an orthogonal arrangement, vertical Wall Truss Columns of the Wall Trusses that are perpendicular to one another are affixed together, thereby preventing "lay-over" of each Wall Truss in the opposite direction to its plane. So unlike traditional structural steel building construction that requires heavy steel beams to restrain horizontal movement of the individual steel columns, and to provide a frame with shear capacity, the geometry of the Stacked Wall Truss Construction of orthogonally positioned vertical Wall Trusses connected at their ends and also on Wall Truss Columns not on the end inherently controls and stabilizes the Wall Truss Column movement that would otherwise occur in plan view. Therefore, no heavy steel beams or customary individual column/beam structure is necessary to create a braced frame or Special Moment Frame. Instead, a dispersion of smaller Wall Truss Columns (as small as 6"×6" in a 14-story building) is created and a dispersion of shear elements is created by virtue of a large number of Wall Trusses that each provide shear capacity, going both plan directions, resulting in an adequate level of aggregated shear capacity without the development of shear capacity in the classic individual steel column/beam frame.

The distinction grows further with the installed floors, which are Floor Modules of light gauge steel or joist types that are preassembled into a coordinated assembly that sits on top of the Floor Shelf located near the top of the Wall Trusses. The Floor Shelf is a tray for the Floor Modules. So when the Wall Trusses are installed on a particular floor of a building, a continuous Floor Shelf has been created in hallways, rooms, apartment units, and outdoor balcony areas such that the Floor Modules of the pre-made hallways, rooms, apartment units, and outdoor balcony areas can be lifted with the crane (where these pre-made Floor Modules are staged for assembly in close proximity to the crane) and they are quickly and efficiently dropped into place. There is no need to make a connection to the building frame before the crane can let go as the Floor Modules just rest on the Floor Shelf with no need for precise positioning. All these Floor Modules sit on a perimeter Floor Shelf of a given building area, and a gap is typically provided on 4 sides to enable easy positioning of the Floor Module, so just drop the Floor Module on the Floor Shelf and move on. Later, by hand or otherwise, the Floor Modules can be moved a bit one way or the other as needed by an inch or two to achieve desired alignment. It requires little skill and is difficult to install incorrectly. Then a concrete Topping Slab is poured on top of the Floor Modules to create a fireproof, soundproof, structural diaphragm, which can also be polished to be the finished floor surface. The resultant floors are implemented without a thick concrete slab capable of spanning across rooms as is present in the traditional poured-in-place concrete building, and also without the heavy individual steel column/beam frame as in classic structural steel construction.

From a structural steel design standpoint, the Wall Trusses can either be a "braced frame" or a "Moment Frame or Special Moment Frame." As a braced frame, a diagonal piece of steel or other brace is installed in at least one bay of each Wall Truss. The diagonal functions as a shear brace in that Wall Truss, greatly increasing its capacity to resist folding in the direction of the Wall Truss. A Special Moment frame is created when, by virtue of just the geometry of the Wall Truss and its members and their connection together, the Wall Truss has shear capacity to resist laying over in the direction of the Wall Truss and functions with the inherent shear capacity of a Vierendeel Truss. Moment Frames flex in the cycle loading of earthquakes and with wind loading, as opposed to just being a rigid braced frame; therefore, Moment Frames tend to perform better and are preferred in tall multi-story buildings and in high seismic load areas. Both implementations work, and the architecture and design engineering of the present art can be either.

The Thin Concrete Wall Panel of the preferred embodiment of the multi-story building is either poured against the pre-made Wall Truss in an on-site forming system, or they are fabricated as another pre-made assembly that is simply affixed to the Wall Trusses. Either way, in the preferred embodiment of the present art, when you hoist a wall frame, it consists of the structural elements, installed utilities, walls, wall finishes, etc. There is no requirement to return to place hand laid brick as in-fill as is done in the traditional poured-in-place concrete buildings today. Hoist the Wall Trusses, place the Floor Modules, pour the Topping Slabs, connect the utilities that have been preinstalled in the Modular Elements at the Utility Interconnect Locations, then move onward and upward.

FIG. 14 illustrates a plan view of one floor of a partially completed multi-story building using the Stacked Prefabricated Structural Steel Wall; FIG. 6 illustrates a perspective view of several typical residential apartments of a multi-story building constructed using the Stacked Wall Truss Construction; and FIG. 15 illustrates a typical completed multi-story building using the Stacked Wall Truss Construction. These figures provide an overview of the multi-story building construction and appearance. In particular, the perspective view of FIG. 6 illustrates the layout of two typical residential apartment units 601, 602 with the final finish elements installed therein. In FIG. 5, these two residential apartment units are shown in their basic exterior wall stage, with the walls 501-505 and floors 506, 507 having been placed by a crane in place on top of the second floor of the partially completed multi-story building. As the construction progresses, successive floors are added until the multi-story building is completed as shown in FIG. 7.

Summary

The present Stacked Wall Truss Constructions and their use in the construction of multi-story buildings departs from the traditional methods of constructing multi-story buildings by the use of prefabricated modular Wall Trusses that are interconnected in three dimensions to enable the rapid completion of building construction with improved quality of construction over that found in traditional multi-story building construction. Further, additional Modular Elements including Floor Modules and Kitchen Modules compliment the Wall Trusses to create a fully modular program of building construction that can be quickly and efficiently accomplished. The resultant building is really a structural steel frame without the use of traditional, heavy, individual stacking columns and beams, since the vertical Wall Trusses create smaller continuous vertical steel elements by virtue of the design configuration and vertical assembly of the Wall Trusses, thereby building construction becomes a process of stacking Wall Trusses, not individual, heavy steel columns and beams. An inner Wall Truss Column Mating Member can be placed hanging out of the bottom of each Wall Truss or sticking out of the top of lower Wall Trusses to enable a Wall Truss placement to be near perfectly positioned on top of the installed Wall Truss below.

What is claimed:

1. A method for constructing a multi-story building, comprising:

assembling a plurality of wall trusses, each comprising a moment frame, consisting of a plurality of vertical members, adjacent ones of which are interconnected only at a top and a bottom by horizontal beams, each spanning the space between adjacent vertical members and connected to facing sides of the vertical members, the interconnection being fixed joints that are capable of transferring and resisting bending moments, wherein at least two vertical members of the wall truss comprise hollow columns; and for at least two floors of the multi-story building:

stacking additional wall trusses on top of existing wall trusses by inserting a mating member into at least two of the hollow columns of the existing wall truss, where the mating member also extends into the hollow columns of the stacked additional wall truss placed on top of the existing wall truss.

2. The method for constructing a multi-story building of claim 1, further comprising:

welding the hollow columns of at least one of the existing wall truss and the additional wall truss to their mating members to create fixed joints.

3. The method for constructing a multi-story building of claim 1, further comprising:

filling the mating members and the hollow columns into which they are inserted with a predetermined amount of material that forms into a solid mass to create fixed joints.

4. The method for constructing a multi-story building of claim 1, wherein the step of manufacturing comprises:

interconnecting the top and bottom beams such that the vertical members of tube steel protrude below the bottom beams a predetermined distance.

5. The method for constructing a multi-story building of claim 1, further comprising:

attaching floor shelves to the top horizontal beam of a lower one of adjoining stacked wall trusses, wherein the floor shelves extend in a horizontal dimension into an interior space of the multi-story building.

6. The method for constructing a multi-story building of claim 5, further comprising:

depositing prefabricated floor modules on top of the floor shelves between facing wall trusses, wherein the prefabricated floor modules extend only between the interior faces of the wall trusses.

7. A multi-story building comprising:

a plurality of wall trusses, interconnected in a three-dimensional matrix to form both a plurality of multi-story exterior walls to enclose a volume of space and a plurality of internal structural partitions which are connected together and to the exterior walls in at least two planar layers to provide lateral support to the exterior walls to which they are interconnected;

wherein each of the wall trusses comprises a moment frame, consisting of:

a plurality of parallel oriented, spaced apart columns each having a top end and a bottom end wherein at least two columns comprise hollow columns, a plurality of linearly oriented and interconnected rectangular wall segments, each comprising first and second horizontal beams each having a first end and a second end, wherein the first end of a first beam and the first end of a second beam are connected to a side of the top end and the bottom end, respectively, of a first column, and the second end of the first beam and the second end of the second beam are connected to a facing side of the top end and the bottom end, respectively, of a second column to form a rectangular wall segment, the interconnection being fixed joints that are capable of transferring and resisting bending moments; and a plurality of wall truss mating members, each insertable into top ends of the first and second hollow columns of a first wall truss and the bottom ends of the first and second hollow columns of a second wall truss that is vertically positioned on top of the first wall truss.

8. The multi-story building of claim 7, further comprising:

a foundation to support walls of the multi-story building; and a plurality of mating anchors embedded in the foundation in a linear array, each mating anchor having a top protruding from the foundation for inserting the protruding top of the mating anchor into the bottom of the hollow columns of a preconfigured set of wall trusses.

9. The multi-story building of claim 7, further comprising:

a plurality of floor shelves, attached to the top horizontal beam of a lower one of adjoining stacked wall trusses, wherein the floor shelves extend from the face of the adjoining stacked wall trusses into an interior space of the multi-story building.

10. The multi-story building of claim 9, further comprising:

a plurality of prefabricated floor modules deposited on top of the floor shelves between facing wall trusses, wherein the prefabricated floor modules extend only between the interior faces of the wall trusses.

* * * * *